US005136966A

United States Patent [19]

Miyagawa et al.

[11] Patent Number: 5,136,966

[45] Date of Patent: Aug. 11, 1992

[54] WEB COATING APPARATUS

[75] Inventors: Ichiro Miyagawa, Hino; Takeshi Kishido, Tokyo; Kazuo Kato; Keiichi Aoki, both of Hachioji, all of Japan

[73] Assignee: Konica Corporation, Tokyo, Japan

[21] Appl. No.: 426,435

[22] Filed: Oct. 25, 1989

[30] Foreign Application Priority Data

Oct. 28, 1988 [JP] Japan ..... 63-272426
Feb. 13, 1989 [JP] Japan ..... 1-33439
Feb. 23, 1989 [JP] Japan ..... 1-43985

[51] Int. Cl.[5] ..... B05C 9/00

[52] U.S. Cl. ..... 118/58; 118/62; 118/410

[58] Field of Search ..... 118/58, 62, 410, 411, 118/407, 423, 459, 325; 427/402, 420, 209

[56] References Cited

U.S. PATENT DOCUMENTS 2,681,294 6/1954 Beguin ..... 118/410
4,455,327 6/1984 Yoshida et al. ..... 118/62
4,561,378 12/1985 Kishido et al. ..... 118/62

FOREIGN PATENT DOCUMENTS 97494 1/1984 European Pat. Off. ..... 118/62
119850 9/1984 European Pat. Off. ..... 118/62
1572231 5/1973 Fed. Rep. of Germany ..... 118/62
2384553 10/1978 France ..... 118/62
48-44171 12/1973 Japan ..... 118/62
49-17853 5/1974 Japan ..... 118/62
58-79566 5/1983 Japan ..... 118/62
65-80 2/1990 Japan ..... 118/62

*Primary Examiner*—David A. Simmons
*Assistant Examiner*—Robert Barker
*Attorney, Agent, or Firm*—Finnegan, Henderson, Farabow, Garrett and Dunner

[57] ABSTRACT

The invention provides an apparatus for coating a web which has a first surface having been coated and a second surface opposite to the first surface. A support roll has a supporting surface around which the web is adapted to be conveyed and an air-jetting device for jetting air through the supporting surface onto the first surface of the web so that the web is supported by air without coming into contact with the supporting surface. A coater is disposed to face the supporting surface so as to coat the second surface of the web. The apparatus is provided with a heater for heating air to be jetted by the air-jetting device so that the temperature of the air becomes higher than that of the first surface of the web.

9 Claims, 4 Drawing Sheets

WEB COATING APPARATUS

BACKGROUND OF THE INVENTION

The present invention relates to an apparatus to coat coating solution in an extremely uniform layer thickness on a web (which is a belt-like flexible support) while the web is supported floatingly.

More particularly, it relates to an apparatus for running a web continuously while supporting and floating a surface of the web having been coated with a photographic light-sensitive material and coating one or more kinds of coating solution onto the reverse side of the web opposite to the coated surface thereof. Specifically the invention relates to a web coating apparatus appropriate to perform both-sided coating continuously.

Conventionally, as a technology for both sided coating, various devices and methods are known, including the following examples:

(1) A method to coat one side of a web, make the coated surface of the web gelled, and then successively coat on the opposite side thereof, while bringing the gelled side in contact with the support roll directly. (Japanese Patent Examined Publication No. 44171/1973)

(2) A method wherein the web is floated up by an air jet from a curved surface of a roll having therein small holes or slits and the edge of the coater is pressed to the web so as to coat it. (Japanese Patent Examined Publication No. 17853/1974)

But the above-mentioned conventional technologies have the following defects:

(1) Even when there are fine dust or scratches on the surface of a support roll that supports a gelled surface, the gelled coated surface is disturbed. When a part of the coated layer adheres on the roll, same trouble is generated. Therefore, maintenance for the support roll is very difficult.

(2) Even when the circumferential speed of the support roll deviates from the conveying speed for the web slightly, gelled coated layer is disarranged remarkably.

Besides, the technology opened in Japanese Patent Examined Publication No. 17853/1974 has the following disadvantageous points:

(3) When the width of a web is large, the difference of the floating level in the width-wise direction becomes large. Therefore, the edge of the coater cannot be pressed to the web uniformly, which makes it difficult to get uniform coating through the whole surface.

(4) Since no consideration is taken to suppress the vibration of a web before and after the coater in this technology, uneven coating easily takes place.

(5) Due to a method to press the coater to a web, a weakness arises with bead coating methods, such as the slide hopper method and others which are normally used in the coating for photographic light-sensitive materials, cannot be used.

So, the present inventors have proposed and put to practical use a web coating method and its apparatus wherein a coater and an air jetting device both arranged to face each other with a continuously running web between them, and the jetting device jets air to the web to support it floatingly and contactlessly from the roll. (Japanese Patent No. 175801/1981)

The first problem of the conventional web coating apparatus was that there had been a possibility of troubles caused by the evaporation of solvent from the web surface in time of successive both sided coating onto a web.

That is to say, in the both sided coating process, a web is kept floating by the air jetting device and conveyed under the condition that coating layers containing almost gelled emulsion stay on the web surface (facing the air jetting device). And, the coating solution whose temperature is from 25° C. to 40° C. is coated onto the reverse side of the web (coater side) by the coater. Due to the coating of high temperature coating solution like this, the temperature of the web is increased. Therefore, the evaporation of solvents (such as vapor) from the coating layers on the web surface is promoted, and since the gap between the web and the air jetting device is so narrow (normally, not more than a few mm), the evaporating vapor becomes saturated in the gap space. Further, with this condition, if the surface temperature of the air jetting device and the gap space atmospheric temperature are lower than the temperature of the saturated vapor, the vapor is condensed again on the surface of the air jetting device to generate dew drops condensation, which attach to the web surface again to finally cause damage on the web surface.

Considering the above-mentioned points, the first object of the present invention is to provide a web coating apparatus wherein vapor from the coating layers on web surface in the air jetting side has no possibility to be condensed again in the gap space.

A second problem in the conventional web coating apparatus, as shown in FIG. 8, results when the web floating level is lowered to form the web deforming part 3*c* so as to bring the part in contact with the web holding surface at the border area and the inlet and outlet sides of the vacuum area on the web holding surface 11*a* of the air jetting device 11 corresponding to the vacuum chamber 8.

That is to say, a web supported floatingly by the air jetting device 11 runs normally around the roll, keeping at least a certain distance from the web holding surface 11*a*. In the border area at the inlet and outlet sides of the vacuum area on the web holding surface corresponding to the vacuum chamber 8, however, the back pressure (a static pressure of the space between the web and web holding surface) at the vacuum area corresponding to the vacuum chamber becomes lower than that of other areas. So, a phenomenon wherein high static pressure built up between the web and the web holding surface flows into the vacuum area is generated. As a result, an amount of high static pressure gas staying at the border area is decreased rapidly to cause the web to float downward. Thus, the web contacts the web holding surface.

Considering the above-mentioned point, the second object of the present invention is to provide a web coating apparatus which can prevent the aforesaid contact trouble by keeping the floating level of a web at a certain height or more in the border area.

Next, the third problem of the above-mentioned conventional coating apparatus is described.

In the above-mentioned conventional technology, a vacuum chamber is used for stabilizing the bead (which is a coating solution bridged on the web surface from the coater.) by sucking it down. Air current in the vacuum chamber gives influence on the coating condition to produce coating unevenness. This occurs because the relation between the movement of the air current and the coating unevenness in the vacuum chamber was not clear, as well as that there was no means to control or adjust the air current.

The present inventors discovered, after an accurate analysis of the air current conditions, the reason for the coating unevenness is because air current flowing in from the web inlet of the vacuum chamber does not defuse entirely but reaches the bead gap portion to make the bead unstable.

Taking the above-mentioned points into consideration, the third object of the present invention is to provide a web coating apparatus wherein air current flowing into the vacuum chamber does not exert any influence on the bead gap portion.

SUMMARY OF THE INVENTION

In order to provide a web coating apparatus wherein a vapor from a coating layer on a web surface on the air jetting device side has no possibility to condense again in the above-mentioned gap space, as is the first object of the present invention, a web coating apparatus wherein a coater and an air jetting device are arranged almost face to face to sandwich therebetween a successively running web having on one of the surfaces a coated layer in an undried condition and wherein coating is conducted by the coater onto the web being floatingly supported by air jetting from the jetting device to a coated layer's side of the web, there is provided a means to heat the temperature of the jetting air to be higher than the maximum surface temperature of the coated layer of the web running on the air jetting device, thereby keeping both the atmospheric temperature of the gap space between an air jetting device and the web and the surface temperature of the air jetting device higher than the temperature of the coated layer of the web so as to prevent condensation.

In order to provide a web coating apparatus which can prevent contact troubles by keeping a floating level of the web in the border area to be not lower than a certain level, as is the second object of the present invention, a web coating apparatus wherein an air jetting device and a coater with a vacuum chamber are arranged almost face to face to sandwich therebetween a web running successively and coating is conducted while air is being jet from the web holding surface of the air jetting device and the web is being floated and supported, the border area of a web holding surface corresponding to the inlet and outlet side of the vacuum area of the vacuum chamber are composed so that the air jetted therethrough can be greater than that through the other web-holding surfaces and the web-floating level in this area can be kept at a certain level.

In order so that air blown into the vacuum chamber does not affect the bead gap portion, as is the third object of the present invention, a web coating apparatus wherein a coater and a web supporting device are arranged almost face to face to sandwich therebetween a successively running web and a vacuum chamber is provided below the bead gap portion between the coater and web. The first composition for accomplishing the third object is the vacuum chamber is composed so that the angle of intersection made by the tangents at the bead gap portion and at the web introducing portion is not more than 145° so that the air current cannot be blown from the web introducing portion to the bead gap portion directly and air current force which comes to the bead gap portion may be decreased remarkably. Further, the second composition of the third object is that in a web coating apparatus wherein a coater and a web supporting device are provided almost face to face to sandwich therebetween a successively running web portion and a vacuum chamber is provided to dispose below the bead gap portion between the coater and web, there is further provided a resistance board for preventing an advance of air to the bead gap portion into the vacuum chamber so as to shield almost all of air flowing from the web introducing inlet to the bead gap portion. With regard to the shape of the resistance board, no opposition is given as far as that it prevents the air to the bead gap portion.

DETAILED DESCRIPTION OF THE INVENTION.

Hereunder, the present invention is explained, referring to an example shown in the attached drawings.

Figure 1:
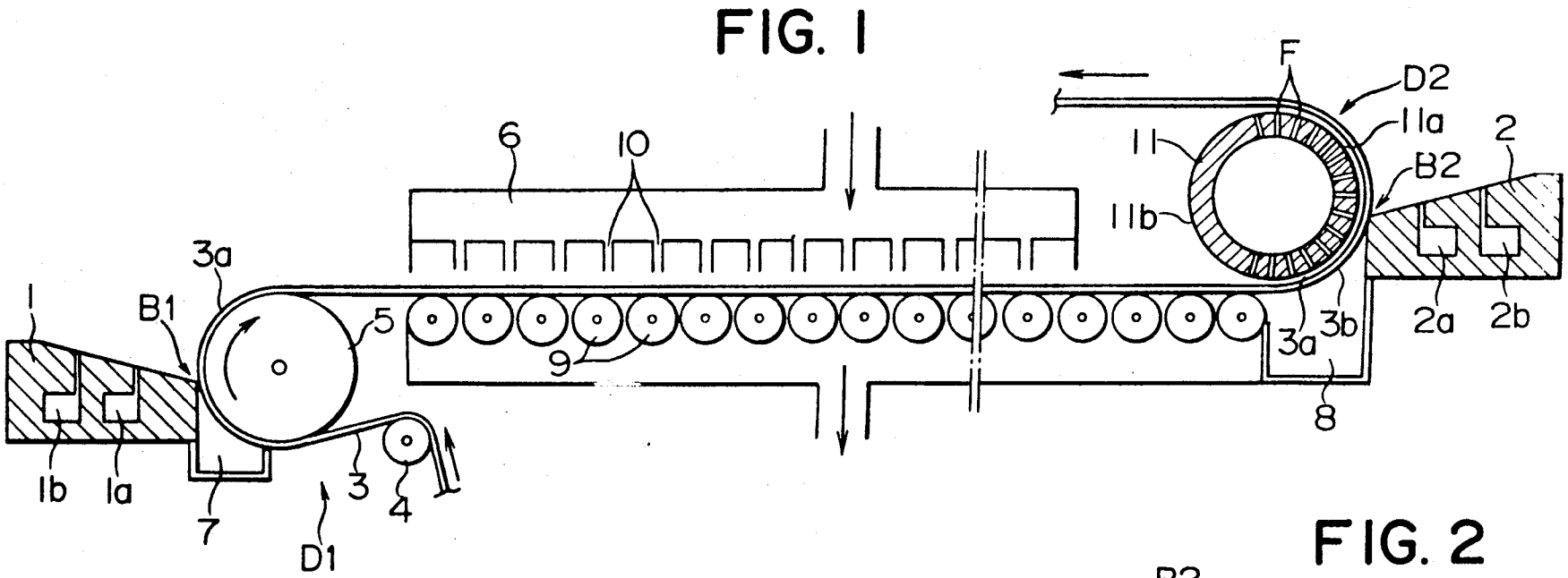
FIG. 1 shows a longitudinal, sectional view of the general composition of a web coating apparatus.
Figure 2:
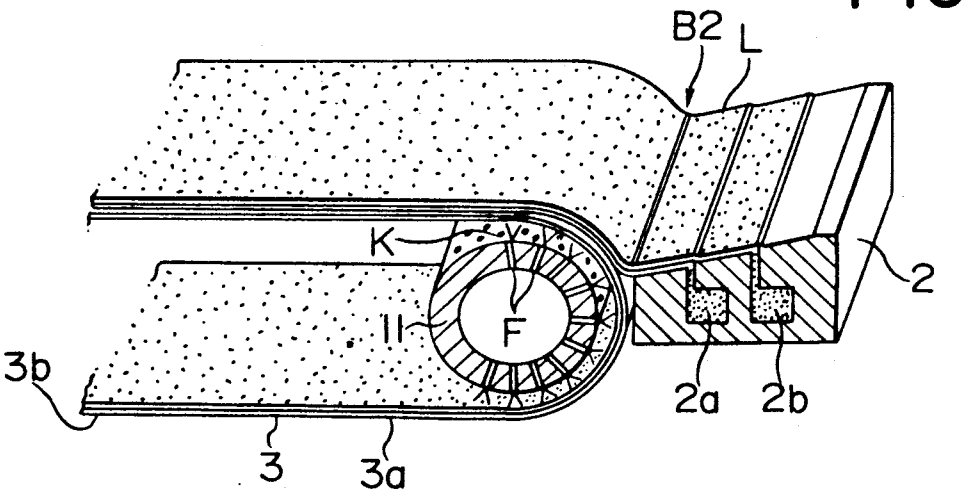
FIG. 2 is a perspective view showing the air jetting device and the second coater.

FIG. 1 shows a longitudinal cross-sectional view of a web coating apparatus showing the total composition. FIG. 2 is a sectional view showing a perspective view of a bead gap portion.

In the figures, numeral 1 is the first coater and 2 is the second coater. The coaters 1 and 2 are provided respectively at the introducing portion D1 and ejecting portion D2 of a web 3 in this order. The coaters 1 and 2 have flow-out slits 1*a*, 1*b* and 2*a*, 2*b*, by which coating of two layers can occur by coating liquids L flowing out from said slits 1*a*, 1*b* and 2*a*, 2*b*. Namely, the first coater 1 coats a coating liquid L on a front surface 3*a* around the introducing portion D1. The second coater 2 coats a coating liquid L on a reverse surface 3*b* around the ejecting portion D2. Thus, coating onto both surfaces can be conducted.

The aforesaid web 3 is contacted and supported by an auxiliary roller 4 to be conveyed to D1. Then, it is contacted and supported by the main roller 5 to roll around, to pass near the first coater 1. Liquid L is coated onto the surface 3*a* by coater 1. Then, the web is conveyed to the chilling zone 6. Elements 7 and 8 represent vacuum chambers. Chambers 7 and 8 each absorb bead portion (the liquid condition bridging from coater to web surface) composed of a coating liquid L coated by each coater 1 and 2 to stabilize the transfer of a coating solution L onto the surface of a web. Chamber 7 is provided below the bead gap B1 of the first coater 1. Chamber 8 is provided below the bead gap B2 of the second coater 2.

The purpose of the aforesaid air chilling zone 6 is to promote gelling by chilling the coating solution L which has been coated onto the surface 3a of the web 3. It is provided with conveying rollers 9 which convey web while chilling it by contacting and supporting the reverse surface 3b (uncoated surface) of the web 3. Small holes (or slits) 10 chill the surface of 3a (coated surface) of the web 3 by blowing cooling air therethrough. The temperature in the chilling zone 6 is adjusted according to the coating condition (the temperature of the coating solution L, thickness of coated layer and coating speed) and the web running condition (the temperature of web, the thickness of web, the running speed of the web). Normally, it is controlled so that the temperature of the web 3 reaches about 2° to 10° C. when the web is conveyed to the second coater 2 through the chilling zone 6.

11 is an air jetting device, a means for supporting the web. The purpose of the air jetting device is to roll the web 3 near the second coater 2 while protecting the surface 3a (coated surface) of web 3 by supporting it floatingly and to coat the coating solution L to the reverse side 3b (uncoated surface). That is to say, on the web holding surface or web supporting surface 11a of the outer core of an air jetting device 11, there are a lot of small air jetting holes F which jet air K from the air jetting device 11 onto the surface of the web 3, thus coater 2 can coat, while web 3 is conveyed floatingly.

Here, the temperature of the jetted air K jet from the air jetting device 11 is made higher than the maximum surface temperature of the surface 3a (coated layer) of the web 3 when it is running on the air jetting device 11, so as to increase the temperature of the jet air K (by a heater and so on, however specific means is not illustrated). That is to say, the temperature of T1 of the web 3 passed through the air chilling zone 6 is usually chilled to about 2° to 10° C. and then the web 3 is conveyed to the air jetting device 11. But, as the coating solution whose temperature T2=about 35° C. is coated onto the reverse surface 3b by the coater 2, the temperature T3 of the surface 3a is increased to about 17° C. while the web is floated and conveyed along the web holding surface 11a. Therefore, by setting the temperature T4 of the air K jet from the air jetting device 11 to be higher than the temperature T3 of the surface 3a (for example 20° C.) a re-condensation of vapor from the coating layer of the surface 3a can be prevented.

In the composition of the FIG. 1 explained so far, the web 3 whose both surface are uncoated is conveyed into the introducing part D1 contacted and supported by an auxiliary roller 4. It rolls around near the first coater 1, being contacted and supported by the main roller 5. It is then coated onto the surface 3a thereof with two layers by the coating liquid L flowing from the flowing slits 1a and 1b. Then, the web 3 is contacted and supported by the conveying roller 9, receiving chilled air by small holes 10 in the chilled air zone 6, to be chilled to around 10 C. Then, it is conveyed to the air jetting device 11.

Web 3 whose coated surface 3a is floated and supported by the air jet from the air-jetting holes F on the web holding surface 11a is coated onto the reverse surface 3b by the second coater 2. Here, as the high temperature coating solution L whose temperature is not less than 30° to 40° C. is coated onto the reverse surface 3b, the temperature of the web 3 is increased and the temperature of the surface 3a (coated surface) is increased too. Therefore, solvent materials evaporate from the surface 3a of the coating layer. But the air jet from minute air jetting holes F of the air jetting device 11 is 20° C. so that its temperature is higher than the maximum surface temperature of coated surface 3a of the web 3. Therefore, dew condensation is not generated on the surface of the air jetting device 11 and the circumference atmosphere of the bead gap B2 of the second coater 2 is kept constant. So, both surfaces of the web 3 are coated uniformly to be conveyed to the ejecting section D2. Thus, the both sided coating is finished.

The web is coated on its opposite surface to which air is jetted to flow and support in the floating and supporting section. Then, the coating layer is gelled in the unillustrated chilling zone delivering chilled air to both surfaces contactlessly with the apparatus, and conveyed to the contactless drying zone. According to the present invention, even when the coated web fluctuates (or vibrates) in the direction perpendicular to the running direction on a place where the coated layer gels contactlessly or in the uncontact drying zone, fluctuation or vibration is absorbed at the floating and supporting portion so that uniform coating can be conducted.

In order to accomplish the first object of the present invention, the present invention is characterized by providing a means for setting the temperature of said jetting air higher than maximum surface temperature the coated layer of the web.

Therefore, there is no possibility that the temperature of the surface of the air jetting device becomes lower than that of the front side of the web. So, there is no fear that vapor from the front side of the web condenses in the gap space or on the surface of the air jetting device. Therefore, no damage is induced by the generation of dew concentration of vapored material, and the effect of this apparatus in quality preservation is excellent.

Next, the composition for accomplishing the second object of the present invention is described.

Figure 3:
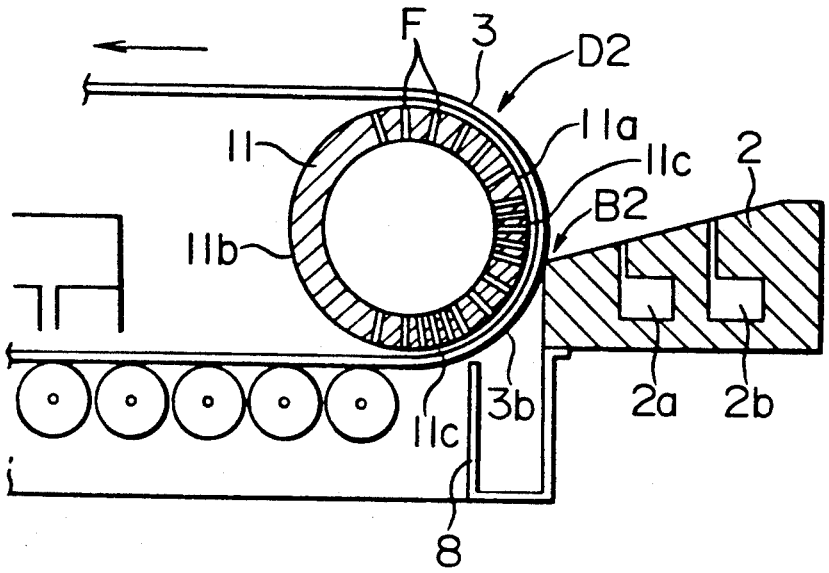
FIG. 3 shows a partial and sectional view of the air jetting device of another embodiment.

FIG. 3 is a partial cutaway view showing the air jetting device of the web coating apparatus shown in FIG. 1. As explained formerly, the web holding surface 11a of the outer core of the air jetting device 11 is made of a smooth cylinder-like surface. Air in the air jetting device 11 is jetted from a lot of minute air jetting holes F provided on the cylinder-like surface to the surface 3a of web 3 so that web 3 is conveyed in a floating condition while being coated by coater 2. Web unholding surface 11b confronting the web holding surface 11a does not need to be a cylinder-like surface, and it is not necessarily provided with minute air jetting holes F.

In the web holding surface 11a shown in FIG. 3, in order to accomplish the second object of the present invention, the inlet and outlet side border area of the vacuum area of the web holding area corresponding to the vacuum chamber 8 are adapted to jet a higher quantity of air jetting (per a unit area) than other areas.

That is to say, in the border area 11c, the air jetting quantity is larger than other web holding areas, by increasing the density of the air jetting holes F or by making their diameters bigger than other areas. So, the decrease of the flowing level of web 3 caused by the decrease of an amount of staying air between the web and the web holding surface can be prevented. The air jetting quantity of the border area 11c may be different according to the web running condition (thickness of web, speed of web running and so forth) and the coating condition (coating thickness, coating viscosity and so forth). But, it is preferable to make the air jetting quantity per a unit area of the border area not less than 2 to 5 times than that of other area of the web holding surface 11*a* (normally, which is not more than 20 Nml/min cm2). Besides, the part where the air jetting quantity is increased is not necessarily limited to the border area 11*c*. It is possible to arrange the part to be an area farther from the vacuum area. In this case, since the above part also is disposed far from the coating point, the vibration of the web at the coating point is decreased so that it can be advantageous to get a uniform coating layer. When the backside 3*b* of the web 3 whose coated surface 3*a* is floated and supported by the air jet from the air jetting hole F on the web holding surface 11*a* of the air jetting device 11 is coated by the second coater, in the inlet and outlet side border area of the vacuum area 11*c* on the web holding area 11*a* corresponding to the vacuum chamber 8, a phenomenon of high static pressure air between the web and the web holding surface flowing into the vacuum area is generated. But, by the above-mentioned composition, as the air jetting quantity of the border area 11*c* is larger than other areas, a decrease of the staying quantity of air due to flowing out can be limited to a certain quantity, and a decrease of the level of the floating of the web in the inlet and outlet side border area can be kept to a certain range. Therefore, the coating condition is maintained constantly and trouble caused by the contact of the web cannot happen. As stated above, in a web coating apparatus wherein an air jetting device and a coater having a vacuum chamber almost confront each other and wherein a web is passing successively between the air jetting device and a coater, in order to accomplish the second object of the present invention, the web coating apparatus is characterized by having a composition that the inlet and the outlet side border area of the vacuum area of the web holding surface corresponding to the vacuum chamber has a larger air jetting quantity than other web holding areas. Therefore, the web floating level at the border area can be kept to not less than a certain level, though static pressure air flows out. So, the contact of the web to the web holding surface near the vacuum chamber can be prevented almost completely while effecting excellent stabilization of the coating process and the improvement of coating quality.

Hereunder, the composition to accomplish the third object of the present invention is explained.

Figure 4:
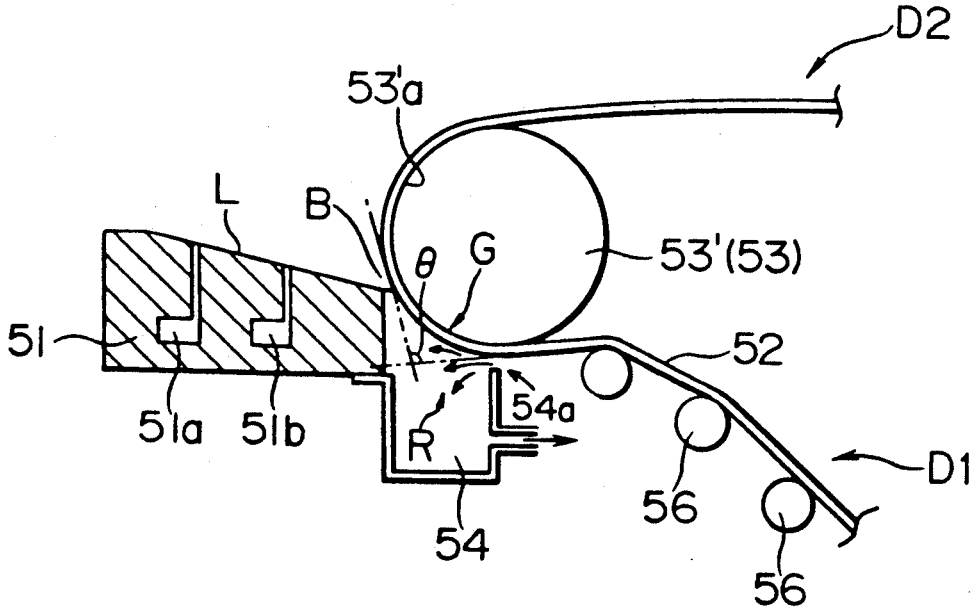
FIG. 4 shows a cross section of a coater of the present invention wherein the vacuum chamber is arranged so that the angle made by crossing tangent lines in advance direction at the bead gap portion and the web introducing portion is not more than 145°.
Figure 5:
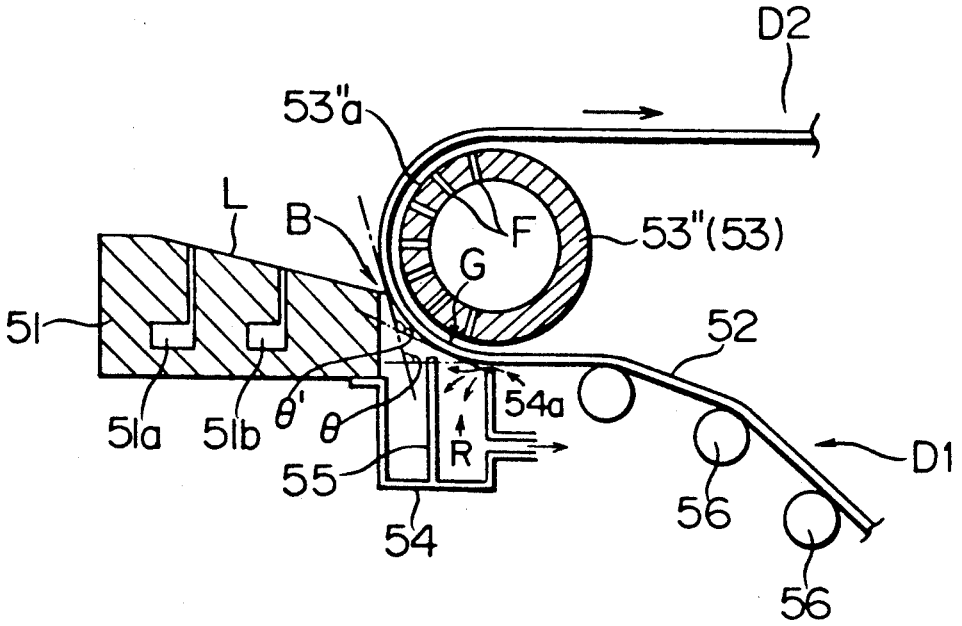
FIG. 5 shows a cross section of a coater of the present invention, wherein a resistance board is set for preventing the advance of air directed toward the bead gap portion in the decompressing area of the vacuum chamber.

FIG. 4 is a cross section of the coater of the present invention wherein the vacuum chamber is composed so that an angle made by two tangents at the bead gap portion and the web introducing inlet is not more than 145°. FIG. 5 is a cross section of the coater of the present invention wherein a resistance board preventing an advance of air to the bead gap portion is provided in the vacuuming area in the vacuum chamber.

In the figure, numeral 51 is a coater which is provided to confront with a web 52 running successively at a minute bead gap B. Coater 51, provided with solution-flowing slits 51*a* and 51*b*, can conduct double-layer coating by transferring coating solution L flowed from slits 51*a* and 51*b* onto the surface 52*a* of the web 52 through the bead gap portion B. The web is a long belt-like body having a length from some hundred meters to some thousand meters. It is composed of a web for photographic light-sensitive material use made of paper or plastic film such as polyethylene terephthalate, triacetate cellulose, and so forth. Web 52 is given a certain tension and speed by the driving and conveying system not illustrated in the figures. It runs successively into the driving part D1.

53 is a web supporting means which is used to go around the web 52 near the coater 51. It is provided at the position which confronts with the coater, and between them the web 52 is running. The web supporting means 53 may be composed of the supporting roller 53' which supports web 52 by contacting as shown in FIG. 4, but also it is composed by an air jetting device 53" which is shown in FIG. 5 which floats and supports web 52 contactlessly. That is to say, the supporting roller 53' is so composed that it can convey the web 52 by contacting and supporting the reverse side of the web 52 (opposite to the coated surface confronting to the coater). On the other hand, in the air jetting device 53' shown in FIG. 5, a lot of minute holes F are provided so that air in the air jetting device 53' is jetted to the reverse surface 52*a* of the web 52 and the web 52 which is to be coated by the coater 51 can be floated and conveyed utilizing the static pressure effect of the air. Each of the supporting roller 53' and the air jetting device 53" is provided with a D-shaped web holding surface 53'*a* and 53"*a* and the web 52 is curved along the web holding surface 53'*a* and 53'*a* to pass the bead gap portion B.

54 is a vacuum chamber which is provided below the bead gap portion B. It absorbs the bead of the bead gap B so that the coating solution L can be transfered to the surface 52*a* of the web 52 stably. The vacuum chamber 54 in FIG. 4 is so composed that an angle (crossed angle) made by tangents at the bead gap portion B and the web introducing inlet 54*a* is not more than 145°. The value of the aforesaid crossed-angle is different according to the relation of the position between the coater 51 and the supporting roller 53'. But it is preferable to make it at least not more than 145° and more preferable to make it not less than 105° if possible from the viewpoint of apparatus composition. The reason for this setting is that the air current R flowing from the web introducing inlet 54*a* of the vacuum chamber 54 advances to the tangent direction at the web introducing inlet without spreading. When the crossed angle is not more than $\theta=145°$, the air current cannot advance directly to the bead gap portion B so that the advance speed is decreased steeply and only a part of the air reaches the bead gap portion B.

It is without saying that the web supporting means 53 can be composed of a floating-supporting type air jetting device 53' as mentioned above.

In FIG. 5, 55 is a resistence board is provided in the vacuum chamber. Its object is to prevent the advance of air directing to the bead gap B in the vacuum area G. The aforesaid resistance board 55 almost divides the vacuum chamber 54 into a web introducing inlet 54*a* side and the bead gap B side The air flow R introduced from the introducing portion 54*a* crashes into it. Therefore, almost all of the advance of the air R to the bead gap B side can be prevented.

Same as FIG. 4, the vacuum chamber 54 is so composed that the angle crossed by the tangents at the bead gap portion B and the web introducing inlet 54*a* is not more than 145°. The position to install the resistence board may be different according to the composition of the chamber 54, but it is preferable that the angle crossed by the tangents at the bead gap B of the web 52 and at aforesaid resistence board 55 is to be not more than 145°. In this case, when $\theta'$ is not more than 145°, inflowing air leaked from the gap between the resistance board 55 and the web 52 cannot reach to the bead gap directly. Its advance speed is decreased remarkably and only a part of inflowing air can reach the bead gap portion B.

As explained above, the web supporting device 53 can be composed of a contact-type roller 53', not of an air jetting device 53''.

Elements 56 . . . are conveying rollers. The aforesaid conveying roller 56 . . . are provided at more than one stage in the former stage of the web supporting device 53 and stabilize the running of web 52 by contacting and supporting the web 52.

Therefore, web 52 is contacted and supported by rollers 56 . . . and is conveyed into the introducing part D1. The web 52 rolls around the coater 51 while it is supported by the web supporting device 53 (a supporting roller 53' or an air jetting device 53'), and it is coated doubly with coating solution L flowed from the flowing slits 51*a* and 51*b*. Here, the vaccum chamber 54 absorbs the bead of the bead gap portion appropriately to stabilize the transfer of the coating solution L to the web 52. Air current R flowing from the web introducing inlet 54*a* of the vacuum chamber 54 advances in the vacuum chamber 54 as a high-speed air jet. But in case of FIG. 4, as the angle is not more than 145°, it does not hit directly the bead gap B and almost of all of it is decreased in speed.

Besides, in the case of FIG. 5, when the resistence board 55 is provided in the vacuum chamber 54, the incoming air R from the web introducing inlet 54*a* hits the resistance board 55 to be decreased, and the air current leaked from the gap between the resistance board 55 and the web 52 is obliged to be diffused and curved. So, it cannot reach the bead gap B.

Then, the web 52 is conveyed into the air chilling zone which is not shown in FIG. 4 and FIG. 5 receiving chilled current from small holes. The web 52 is chilled to about 10° C. In the case of one-surface coating, the web is conveyed out as a finished product through the drying process. In case of both sided coating, it is conveyed to the second coater (not illustrated in FIG. 5). The web whose both surfaces are coated uniformly is introduced from the ejecting part D2 to the chilling and drying process. Thus, the both sided coating process is finished.

EXAMPLE

In the present apparatus illustrated in FIG. 4, angle $\theta$ was changed and coating characteristics of the apparatuses were compared. The result was obtained as shown in Table 1.

TABLE 1

| Apparatus | $\theta$ | Coating condition |
|---|---|---|
| A: | 155° | Transversal step-like or shard-like coating unevenness happens partly. |
| B: | 145° | Weak coating unevenness happens, but it does not matter. |
| C: | 105° | Coating unevenness does not happen. |

As explained above, in a web coating apparatus wherein a coater and a web supporting device almost confront each other and a web is running successively between them and wherein a vacuum chamber is provided below the bead gap portion where the aforesaid coater and web access each other, as the vacuum chamber is composed so that the angle $\theta$ is not more than 145°, an air current incoming from the web introducing inlet does not directly reach the bead gap portion, and is decreased. Therefore, there is no possibility to hit the bead gap portion directly.

Besides, in a web coating apparatus wherein a coater and a web supporting device almost confront each other and a web is running successively between them and wherein a vacuum chamber is provided below the bead gap portion where the aforesaid coater and web access each other, by providing a resistance board to prevent an advance of an air current directed to the bead gap portion in the vacuum chamber, an air current incoming from the web introducing inlet can be prevented, so that air reaching the bead gap portion can be almost dissipated.

As mentioned above, in either invention, unstabilization of bead caused by hitting of air current can be prevented and the constancy of coating condition can be maintained. As a result, such a coated layer having a uniform thickness and a uniform surface condition can be obtained. So, the present invention can produce a high quality web and the stabilization of production.

In conducting all of the Examples in the present invention mentioned above, an air current hits the coating layer gelled at the floating and supporting part. So, in order not to put the coating layer out of order by dynamic pressure of this air, it is preferable to decrease the temperature of the coating layer just before the web enters into the floating and supporting part and is chilled to about 10° C. The gel strength of the coating layer should be increased.

For jet air used in the air jetting device, anything can be used so far as there is no safety problem such as N2 gas and air, but air is the most normal to be used.

Figure 6:
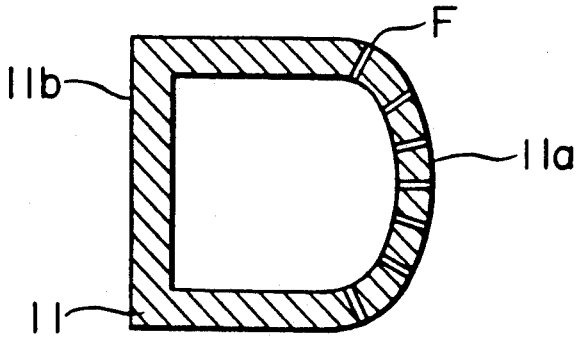
FIG. 6 shows another example of an air jetting device.
Figure 7:
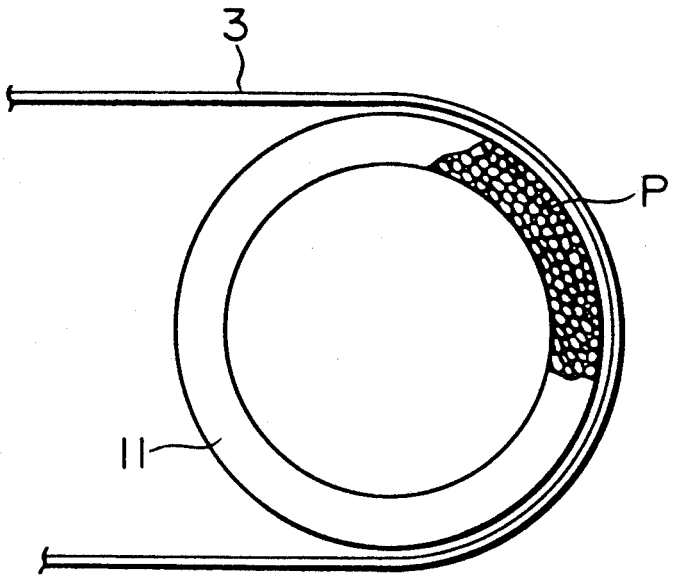
FIG. 7 shows an example of an air jetting device using a multi hole member.
Figure 8:
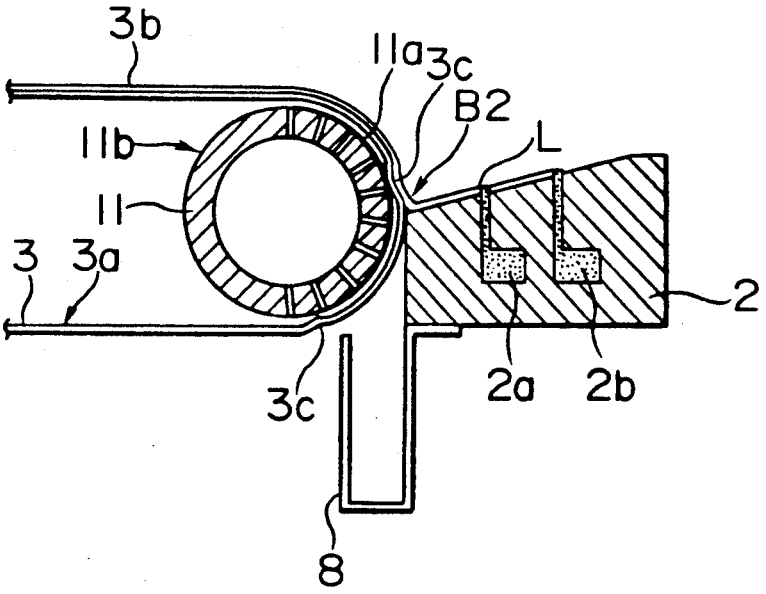
FIG. 8 PRIOR ART
FIG. 8 shows a longitudinal sectional view of an air jetting device and a coater in the conventional apparatus.

As a coating web used in the present invention, photographic light-sensitive material using paper and plastic film made from polyethylene terephthalate, triacetate cellulose and so on can be used. Besides, there is no limitation in material for the floating and supporting part of the air jetting device as far as it can bear the inside pressure of a hollow part. What is preferable is stainless steel or brass steel plated by hard chrome on the surface. And, considering ease of making holes because in the present invention through-holes are provided, such plastic materials as bakelite and acryl resin can be used. So far, explanations made have been of the present invention, but the examples of the present invention are not limited to these. As for the air jetting device, any type can be used, as long as a continuous curved surface is provided on the outer surface of the uncontacting support portion for preserving high static pressure at the gap, whereby air can be jetted from the curved surface and other conditions of the present invention are satisfied. It is not necessary that the external form is roll-like or the part to let air pass from inside of the air jetting device to the external part is a through-hole. It is good to use a web coating device having an air jetting device of different composition. For example, for the shape of an air jetting device, semi-cylinder type or elliptical cylinder can be used. Also, such a form as illustrated in FIG. 6 which is another example of the air jetting where only the floating and supporting part has a curve on the external surface and the other surfaces are composed as a plane. On the other hand, an important role of the part allowing the air supplied to the inside of the air jetting device to pass to the outside part is to provide a pressure loss as well as let air pass. If this condition is satisfied, any form can be used. A through-hole, roll hole or polygon hole can be used. Besides, such a form as that of the external core of the air jetting device on the floating and supporting part is composed of multi-hole member P made of sintered metals and so forth can be used as shown in FIG. 7. Besides, it is possible that all of the parts from the air inlet part to the external surface on the floating and supporting part can be composed of the multi-hole member, instead of the air jetting device being hollow.

As a coating method to coat onto one surface and reverse surface of a coating web, conventional methods such as the bead coating method, the extrusion coating method, and the curtain coating method can be used.

What is claimed is:

1. An apparatus for coating a web which has a coated first surface and a second surface opposite to the first surface, comprising:

a supporting means for supporting the web, including a supporting surface along which the web is adapted to be conveyed, said supporting surface being disposed to face the first surface of the web;

an air-jetting means for jetting air through said supporting surface onto the first surface of the web so that the web is supported by air without coming into contact with said supporting surface;

a coating means disposed to face said supporting surface for coating the second surface of the web; and a heating means for heating the air to be jetted by said air-jetting means so that the temperature of the air becomes higher than the temperature of the first surface of the web.

2. The apparatus of claim 1, wherein the supporting surface comprises a curved surface and the air jetting means jets the air through the curved surface onto the web.

3. The apparatus of claim 2, wherein the coating means faces the curved surface of the supporting means so as to form a coating point for transferring the coating onto the web.

4. The apparatus of claim 3, wherein the coating means includes a vacuum chamber for providing a reduced pressure region on the web.

5. The apparatus of claim 4, wherein the vacuum chamber includes an inlet point positioned upstream of the coating point in the conveyed direction of the web, and is disposed so that the reduced pressure region is formed from the coating point to the inlet point, wherein the curved surface is disposed with respect to the inlet point such that a first tangent line drawn to the curved surface at the inlet point crosses at an angle not larger than 145 degrees with a second tangent line drawn to the curved surface at the coating point.

6. The apparatus of claim 5, wherein said angle is not larger than 105 degrees.

7. The apparatus of claim 4, wherein said vacuum chamber includes a resistance board for decreasing the velocity of air current introduced at the inlet point.

8. An apparatus for coating a web with a solution, comprising:

supporting means for supporting the web, said supporting means including a curved surface around which the web is adapted to be conveyed;

air-jetting means for jetting air through said curved surface onto the web, so that the web is supported by air without coming into contact with said curved surface; and coating means disposed opposing said curved surface of said supporting means for forming a coating point for transferring the solution onto the web, said coating means including a vacuum chamber for providing a reduced pressure region on the web, said vacuum chamber including an inlet point positioned upstream of the coating point in the conveyed direction of the web, and being disposed so that the reduced pressure region is formed from the coating point to the inlet point and including a resistance board for decreasing the velocity of air current introduced at the inlet point;

the curved surface being disposed with respect to the inlet point such that a first tangent line drawn to the curved surface at the inlet point crosses a second tangent line drawn to the curved surface at the coating point at an angle not larger than 145°.

9. An apparatus for coating a web which has a coated first surface and a second surface opposite to the first surface, comprising:

a supporting means for supporting the web, including a supporting surface along which the web is adapted to be conveyed, said supporting surface being disposed to face the first surface of the web;

an air-jetting means having air jetting holes for jetting air through said supporting surface onto the first surface of the web so that the web is supported by air without coming into contact with said supporting surface;

a coating means disposed to face said supporting surface for coating the second surface of the web, said coating means including a vacuum chamber for providing a reduced pressure region on the web; and said supporting surface having a boundary area corresponding to a boundary line of the reduced pressure region of the web, said air jetting means having an increased density of air jetting holes oriented so as to jet a larger amount of air upon the web in said boundary area than the amount of air jetted upon areas other than said boundary area.

* * * * *